United States Patent [19]

Gerasimenko et al.

[11] Patent Number: 5,031,707

[45] Date of Patent: Jul. 16, 1991

[54] APPARATUS FOR MAKING HOLES IN SOIL

[76] Inventors: Nikolai P. Gerasimenko, ulitsa Botevgradskaya, 63, kv. 54, Saransk; Leonid M. Bobylev, ulitsa Petrozavodskaya, 15, korpus 2, kv. 229; Alexandr S. Kovalev, ulitsa Kulakova, 12, korpus 1, kv. 10, both of Moscow; Valentin K. Svirschevsky, ulitsa Derzhavina, 19, kv. 59; Nikolai J. Klimov, ulitsa Krylova, 29, kv. 49, both of Novosibirsk; Yakov A. Gokhman, ulitsa Gladkova, 14, kv. 49, Krasnoyarsk, all of U.S.S.R.

[21] Appl. No.: 457,822

[22] PCT Filed: Feb. 21, 1989

[86] PCT No.: PCT/SU89/00050

§ 371 Date: Jan. 12, 1990

§ 102(e) Date: Jan. 12, 1990

[87] PCT Pub. No.: WO89/11005

PCT Pub. Date: Nov. 16, 1989

[51] Int. Cl.[5] ..... E21B 7/24; E21B 7/26

[52] U.S. Cl. ..... 175/19; 175/55; 175/94; 175/323

[58] Field of Search ..... 175/19, 55, 102, 98, 175/323, 325, 391, 388, 408, 394, 94, 334, 345, 348

[56] References Cited

U.S. PATENT DOCUMENTS

| | | | |
|---|---|---|---|
| 3,926,267 | 12/1975 | Svirochevsky et al. | 175/19 |
| 4,230,191 | 10/1980 | Svirschevsky et al. | 175/94 X |
| 4,484,640 | 11/1984 | Feklin et al. | 175/19 |

FOREIGN PATENT DOCUMENTS

| | | | |
|---|---|---|---|
| 2946873 | 7/1981 | Fed. Rep. of Germany | 175/102 |
| 497401 | 3/1976 | U.S.S.R. | 175/334 |
| 526696 | 9/1976 | U.S.S.R. | 175/348 |
| 724637 | 3/1980 | U.S.S.R. | 175/325 |
| 825797 | 5/1981 | U.S.S.R. . | |
| 977613 | 11/1982 | U.S.S.R. . | |
| 1317088 | 7/1987 | U.S.S.R. | 175/323 |

OTHER PUBLICATIONS

Uplotnenia i Uplotnitelnaya tekhnika, pp. 166–168, 1986.

Osnovy Konstruirovania, vol. 1; pp. 486–490; 1988.

Prokhodka skvazhin v grunte sposobom raskatki, 1982.

Osnovy Konstruirovania, vol. 2, pp. 352–353; 1988.

*Primary Examiner*—Hoang C. Dang

*Attorney, Agent, or Firm*—Lilling and Lilling

[57] ABSTRACT

An apparatus has an eccentric shaft on which are mounted rolls connected to one another by flexible members in the form of a corrugated collar for end sealing of the rolls and with auxiliary members for radial sealing of the rolls. The auxiliary members are received in a radial clearance defined between the adjacent rolls which are made hollow.

5 Claims, 2 Drawing Sheets

APPARATUS FOR MAKING HOLES IN SOIL

BACKGROUND OF THE INVENTION

1. Field of the Invention

The invention relates to construction technology, and, more specifically, it deals with apparatuses for making holes in soil by expansion rolling. Such apparatuses may be used for underground soil compaction and also for forming cast-in-place piles, for trenchless construction of pipelines, for the construction of footings for power transmission lines supports, and the like.

DESCRIPTION OF THE RELATED ART

Known in the art are several types of apparatuses for making holes in soil. Thus known in the art is an apparatus (SU, A 825,797) having an eccentric shaft with rolls, one roll being operatively connected to the shaft of a motor having its casing connected to the eccentric shaft, the rolls being connected to one another by means of flexible members.

The apparatus is deficient in that it can only be operable when angular velocities of all the rolls are identical. This can only be achieved if the relative eccentricities of all the rolls are identical (the absolute eccentricities of the rolls are directly proportional to their diameters) which substantially affects the advance speed of the apparatus. In practice the advanced speed decreases by several times and the apparatus can even stop altogether under unfavorable conditions, e.g. upon a change in soil structure or moisture content.

Also known in the art is an apparatus (SU, A, 977613), comprising an eccentric shaft having rotatable rolls mounted thereon which are connected to one another by means of a flexible member for their sealing, and metal rings connected to the flexible member and engageable with the end of the rolls.

This construction of the end seal of the rolls cannot rule out penetration of fluid soil and moisture to the interior spaces of bearings thus shortening service life of the apparatus.

During operation of the apparatus in wet soils, ground water containing soil particles penetrates through clearance between the rotating rolls and metal rings to the interior space of the apparatus.

The construction of the end seal between the rolls cannot ensure uniform pressure of the metal rings against the end faces of the rolls so that one of the rings can move open, and water with soil particles will get into the interior of the apparatus.

In addition, when soil particles get into these clearances, one of the metal rings may be jammed. In this case, the difference between angular velocities of the adjacent rolls may cause breakage of the collar (flexible member).

SUMMARY OF THE INVENTION

The invention is based on the problem of providing an apparatus for making holes in soil which is so constructed as to prolong its service life by preventing moisture and soil particles from getting into its interior spaces.

This problem is solved by an apparatus for making holes in soil, comprising an eccentric shaft having rolls mounted thereon for rotation and connected to one another by means of flexible members for end sealing of the rolls and metal rings. According to the invention, there are provided auxiliary members for radial sealing of the rolls, the rolls being hollow, the auxiliary flexible members being received in a radial clearance defined between the adjacent rolls, the flexible members for end sealing being made in the form of a corrugated collar.

The metal rings surround the corrugated collars and are engageable with the adjacent rolls with their sharp edges.

This construction rules out penetration of water and soil particles to the interior of the apparatus, hence, in bearings.

The construction of the end seal between the rolls ensures uniform pressure of the metal rings against the end faces of the rolls because the corrugated collar is mounted coaxially with the working member by means of shoulders on the end faces of the rolls, the inside diameter of the shoulders being greater than the outside diameter of the metal rings by an amount equal to two times the eccentricity "e". The inner surface of the shoulders is conical. With a radial movement of the rolls with respect to the collar, soil disposed between the shoulder of the roll and the ring of the collar is forced out of the clearance thereby ensuring a stable position of the collar with respect to the axis of the working member and preventing the collar from misalignment and deformation that might be caused by soil accumulation.

The outer edge of each metal ring engageable with the roll is sharp so as to minimize the zone of contact between the rings and rolls for developing the desired contact pressure in the contact zone.

The sharp end face of the metal ring not only provides for the desired pressure in a friction pair, but also ensures cleaning of the contact surface from soil by moving the soil by the outer surface of the ring towards the conical surface of the shoulder as a result of the radial motions of the end faces of the rolls.

If moisture penetrates through the zone of contact between the metal rings and end faces of the rolls, the auxiliary members for radial sealing of the rolls completely eliminate penetration of moisture to the interior of the apparatus.

The points of contact between the auxiliary member and the roll surfaces are coated with an antifriction material ensuring easy rotation of the rolls by lowering friction force between the auxiliary member and the roll.

A grease creating a back pressure inside the apparatus also prevents moisture from getting into bearings.

Process capabilities of the apparatus, according to the invention, are enhanced owing to the fact that at least one portion of the surfaces of the adjacent rolls is made in the form of a part of a strip winding. This construction ensures formation in the hollow wall of a helical depression so that the area of contact between the hole and a material filling the hole is enlarged.

Holes having a deep helical groove in the wall for making cast-in-place piles and anchors ensure a several-fold increase in load-bearing capacity of such structures. It is especially advantageous in reinforcing foundations of industrial and general-use buildings and installations.

BRIEF DESCRIPTION OF THE DRAWINGS

Advantages of the invention will become apparent from the following detailed description and accompanying drawings illustrating specific embodiments of the invention, in which.

DESCRIPTION OF THE PREFERRED EMBODIMENTS

Figure 1:
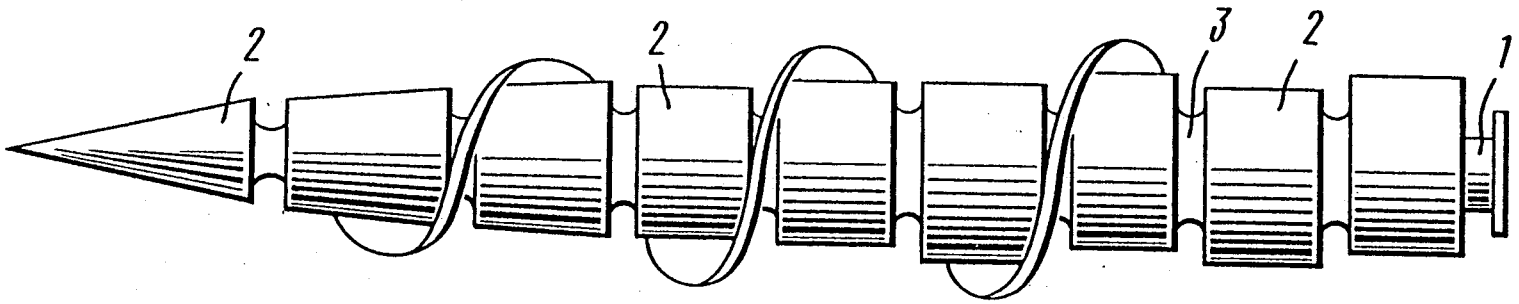
FIG. 1 shows a general view of an apparatus for making holes soil, according to the invention.
Figure 2:
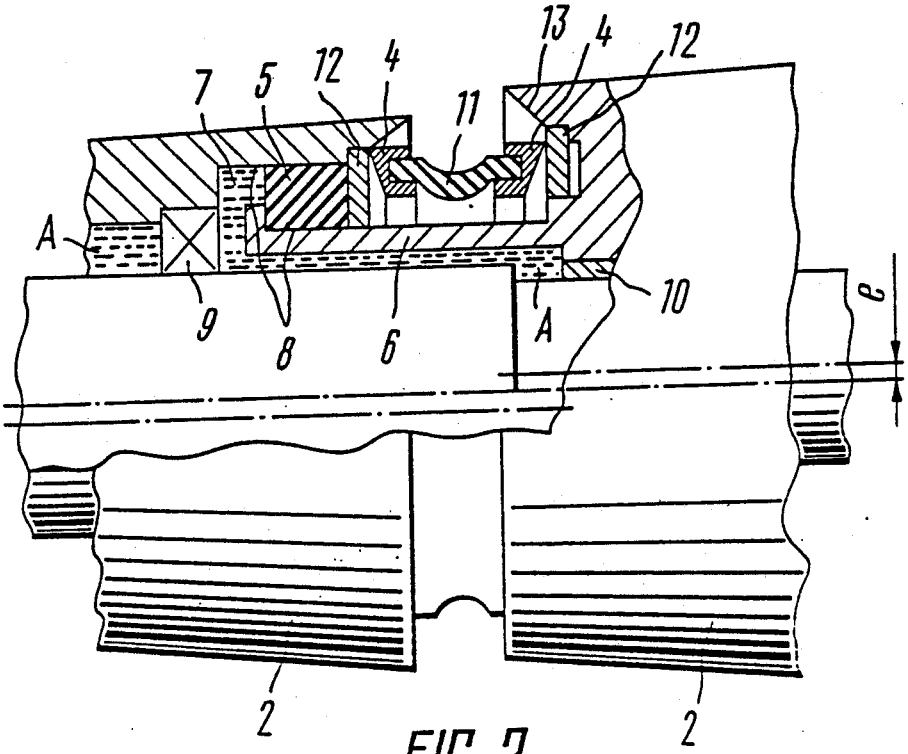
FIG. 2 shows end and radial seals between adjacent rolls.

An apparatus for making holes in soil (FIGS. 1, 2) comprises an eccentric shaft 1 on which are mounted for rotation rolls 2 which are connected to one another by means of flexible members 3 for end sealing of the rolls 2, and metal thrust rings 4. The apparatus has auxiliary members 5 for radial sealing of the rolls 2, each of the rolls being hollow.

The rolls are conical with a gradual increase in their diameter, and each roll has a shank 6 received in the interior of the adjacent roll so as to define a radial clearance 7 between the rolls which accommodates the auxiliary member 5. The points of contact between the auxiliary member and the roll surfaces are coated with an antifriction material 8 ensuring a decrease in friction forces of cohesion between the auxiliary members 5 and rolls 2 during their rotation. The antifriction material may be in the form of bronze, brass, and the like. The rolls are journalled on the eccentric shaft by means of antifriction bearings 9 or by means of sliding-contact bearings 10.

The flexible members 3 for end sealing are in the form of a corrugated collar 11 which is elastic and which is made preferably of rubber in a mold.

The metal thrust rings 4 surrounding the corrugated collars 11 are made with sharp edges engageable with the adjacent rolls 2 through the agency of rings 12 freely rotating in the rolls. The ends of the rolls 2 are made with a shoulder 13 having an inside diameter which is greater than the outside diameter of the metal thrust ring 4 by the amount of two times the eccentricity "e".

Figure 3:
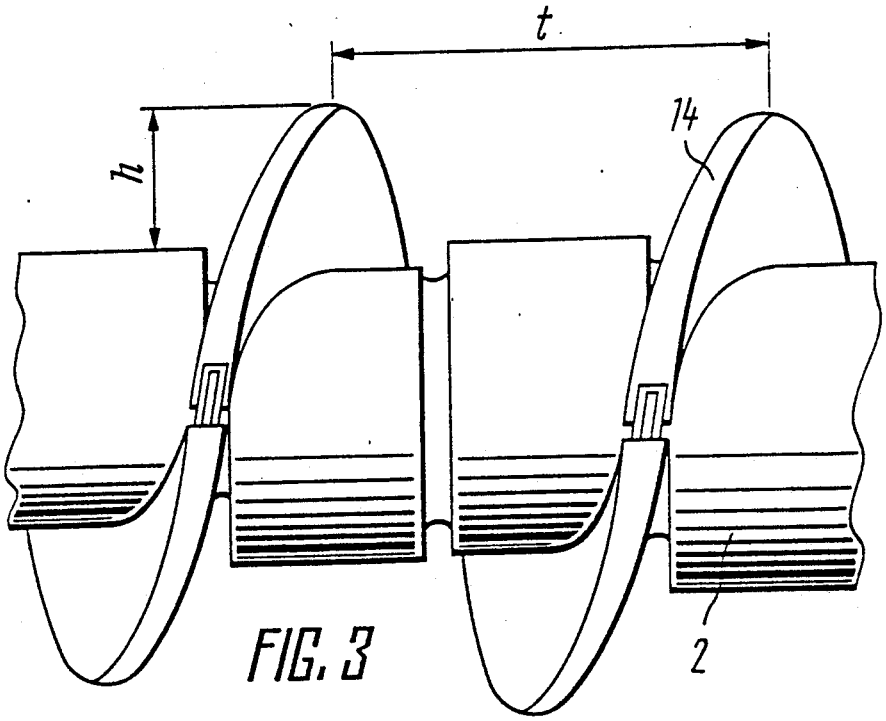
FIG. 3 shows an embodiment of a helical strip on the roll surface.

One portion of the surfaces of the adjacent rolls is made in the form of a part of a strip winding 14 (FIG. 3). The end faces of the conjugated parts of the strip winding are made in the form of a splined joint so as to allow them to move freely in the radial direction.

The interior spaces of the rolls 2 are filled up with grease A for lubrication of the bearings 9, 10 and for preventing water and soil particles from getting to the interior of the apparatus.

The eccentric shaft 1 is connected to a drive (not shown in the drawings).

The apparatus functions in the following manner.

The apparatus is inserted into a conical depression preliminarily made in soil by means of an auger borer. The depth of the depression should be such as to receive 3–4 front-end rolls. Then the drive of the apparatus is turned on. When the shaft 1 of the working member rotates, the rolls 2 rolling over the walls of the conical depression in the soil ensures the axial feed of the working member by screwing in the soil and by forming a hole with compacted walls.

During formation of the hole soil spills down and gets into the end clearances between the adjacent rolls, but soil cannot get into the interior of the apparatus. The forces of elasticity in the corrugated collar 11 hold it in the position coaxial with the working member without deformations in the radial direction.

The end faces of the rolls are cleaned from soil by the sharp edges of the rings 4, and soil is forced out of the end clearances between the rolls to the outside space where it is rolled into the hole walls by the adjacent rolls.

The use of the end and radial seals and filling the interior spaces of the rolls with grease improve reliability of the apparatus, according to the invention, in operation.

The part of the strip winding rigidly secured to the roll 2 regularly forms with the leading edge thereof a depression in the hole wall upon every revolution of the roll about the axis of the hole so as to form a continuous helical depression, the depth of which is determined by height "h" of the part 14 of the helical winding.

If the helical winding 14 is provided on all the rolls of the apparatus, formation of the helical depression in the soil can be carried out simultaneously with the formation of the hole. The movable interconnection of the strip windings contribute to the continuity of the strip winding without, at the same time, limiting the rolls movement along a spiral path. The resultant helical hole has an increased face area of a cast-in-place pile or anchor constructed in the hole by 2–3 times, hence, they will have an enhanced load bearing capacity in comparison with piles constructed in holes with smooth walls. During the advance through the hole, the apparatus bears with its strip winding against the walls of the depression for its advance which can ensure a high enough cohesion in wet clayed soils.

The pitch of the helical depression "t" in the hole wall depends on the amount of feed of the working member per one revolution of the shaft, hole diameter and difference between diameter of the hole and diameter of the roll having the strip winding.

The apparatus, according to the invention, may also be used for rolling helical grooves in holes preliminarily formed by any other known method such as drilling, punching, puncturing or percussion. The load bearing capacity of piles or anchors constructed in the shaped hole made by means of the apparatus, according to the invention, is enhanced in comparison with those constructed in a smooth-walled holes. Piles and anchors will have the desired load bearing capacity with a smaller length.

The apparatus, according to the invention, may be advantageously used in the construction and, more particularly, in the earth moving operations for the formation of vertical, inclined and horizontal holes by soil expansion by rolling in the construction of cast-in-place piles, in compacting soil underground, in erecting walls in soil, anchors, power transmission line supports, in trenchless construction of pipelines, tunnels and wells, in carrying out reinforcement of foundations of operating buildings and installations, and the like.

The provision of new structural members in the apparatus in the form of radial seals and a strip winding on the roll surface have a positive effect on reliability of the apparatus, according to the invention, and enlarge its process capabilities.

These properties make it possible to use the apparatus, according to the invention, in various earth moving applications and enhance their productivity and quality.

We claim:

1. An apparatus for making holes in soil, comprising: and eccentric shaft on which are mounted rotation for rolls connected to one another by means of flexible members for sealing ends of the rolls and metal thrust rings, auxiliary flexible members for radial sealing of the rolls each roll being hollow, adjacent ends of adjacent rolls overlapping, overlapped portions of the rolls defining a radial clearance, the auxiliary flexible members being received in the radial clearance defined between adjacent rolls, the flexible members of sealing ends of the rolls being in the form of a corrugated collar.

2. An apparatus according in claim 1, wherein the metal thrust rings having sharp edges surround ends of the corrugated collars and are engageable with adjacent rolls with the sharp edges.

3. An apparatus according to claim 1, wherein a surface of the rolls in the radial clearance is coated with an antifriction material.

4. An apparatus according to claim 1, wherein at least one part of a radially outward directed surface of adjacent rolls is made in the form of a portion of a strip winding.

5. An apparatus according to claim 1, wherein interior spaces of the rolls are filled with grease.

* * * * *